United States Patent [19]

Ohta

[11] Patent Number: 4,958,669

[45] Date of Patent: Sep. 25, 1990

[54] DEVICE FOR FILLING SPECIFIED AMOUNT OF LIQUID

[75] Inventor: Shohei Ohta, Tokushima, Japan

[73] Assignee: Shikoku Kakoki Co., Ltd., Tokushima, Japan

[21] Appl. No.: 385,957

[22] Filed: Jul. 28, 1989

Related U.S. Application Data

[63] Continuation of Ser. No. 180,921, Apr. 13, 1988, abandoned.

[30] Foreign Application Priority Data

Apr. 14, 1987 [JP] Japan ..... 62-56505[U]

[51] Int. Cl.[5] ..... B67C 3/20; B65B 3/12

[52] U.S. Cl. ..... 141/311 A; 141/86; 141/31; 141/116; 141/258; 222/108; 239/533.1; 239/590.3

[58] Field of Search ..... 141/1, 86, 116, 70, 141/311 A, 286, 31, 115, 258; 222/108, 109, 491

[56] References Cited

U.S. PATENT DOCUMENTS

| | | | |
|---|---|---|---|
| 948,900 | 2/1910 | McKim | 4/292 |
| 1,269,902 | 6/1918 | Butler | 4/292 |
| 1,762,734 | 6/1930 | Oakley | 4/292 |
| 2,779,506 | 10/1955 | Gajda | 141/116 X |
| 3,415,294 | 12/1968 | Kelly | 141/286 X |
| 3,788,485 | 1/1974 | Bruning | 4/292 |
| 3,792,724 | 2/1974 | Hunter | 141/115 |
| 3,870,199 | 3/1975 | Dugger et al. | 141/186 |
| 3,913,801 | 10/1975 | Wise et al. | 141/116 X |
| 4,135,100 | 1/1979 | Harada et al. | 73/64.4 |
| 4,195,694 | 3/1980 | Hickerson | 239/533.1 |
| 4,212,373 | 7/1980 | Scragg | 141/330 |
| 4,230,160 | 10/1980 | Buckley | 141/116 |
| 4,248,385 | 2/1981 | Hickerson | 239/533.1 X |
| 4,309,455 | 1/1982 | Miyagawa | 204/17 |
| 4,351,373 | 9/1982 | Mechalas | 141/51 |
| 4,526,735 | 7/1985 | Norota et al. | 264/27 |
| 4,711,277 | 12/1987 | Clish | 141/311 A |
| 4,730,786 | 3/1988 | Nelson | 239/590.3 |

FOREIGN PATENT DOCUMENTS

| | | | |
|---|---|---|---|
| 0138234 | 4/1985 | European Pat. Off. | 141/115 |
| 8301474 | 4/1983 | PCT Int'l Appl. | 4/292 |

*Primary Examiner*—Ernest G. Cusick

*Attorney, Agent, or Firm*—Armstrong, Nikaido, Marmelstein, Kubovcik & Murray

[57] ABSTRACT

A device for filling a specified amount of liquid comprising a vertical tubular filling cylinder, and at least one perforated plate attached to the lower end of the nozzle for preventing the liquid from flowing out of the nozzle by the surface tension of the liquid against gravity.

12 Claims, 3 Drawing Sheets

DEVICE FOR FILLING SPECIFIED AMOUNT OF LIQUID

This application is a continuation of application Ser. No. 180,921 filed Apr. 13, 1988, now abandoned.

BACKGROUND OF THE INVENTION

The present invention relates to a device for use in filling containers with a liquid, such as flowable food, in a specified amount in each container.

Liquid filling devices are known wherein a filling nozzle body is provided at its open lower end with metal netting for preventing the liquid from flowing out of the nozzle body under gravity by the surface tension of the liquid.

The above device has the following problem: The metal netting has portions where the constituent warp and weft wires overlap each other. When the nozzle is to be cleaned and sterilized, it is difficult to remove the liquid from the overlapping portions, so that the metal netting cannot be cleaned and sterilized efficiently. If the liquid contains the flesh of fruit or fibrous substance, such substance becomes lodged in wire lapping portions and is extremely difficult to remove.

SUMMARY OF THE INVENTION

The main object of the present invention is to provide a liquid filling nozzle free of the above problem.

The device of the invention for filling a specified amount of liquid into containers comprises a vertical tubular filling nozzle and at least one perforated plate attached to the lower end of the nozzle for preventing the liquid from flowing out of the nozzle by the surface tension of the liquid against gravity.

The perforated plate attached to the lower end of the filling nozzle according to the invention has no wire lapping portion unlike the metal netting. The nozzle can therefore be cleaned and sterilized effectively.

BRIEF DESCRIPTION OF THE DRAWINGS

The drawings show an embodiment of the invention.

DESCRIPTION OF THE PREFERRED EMBODIMENT

An embodiment of the invention will be described below with reference to the drawings.

Figure 1:
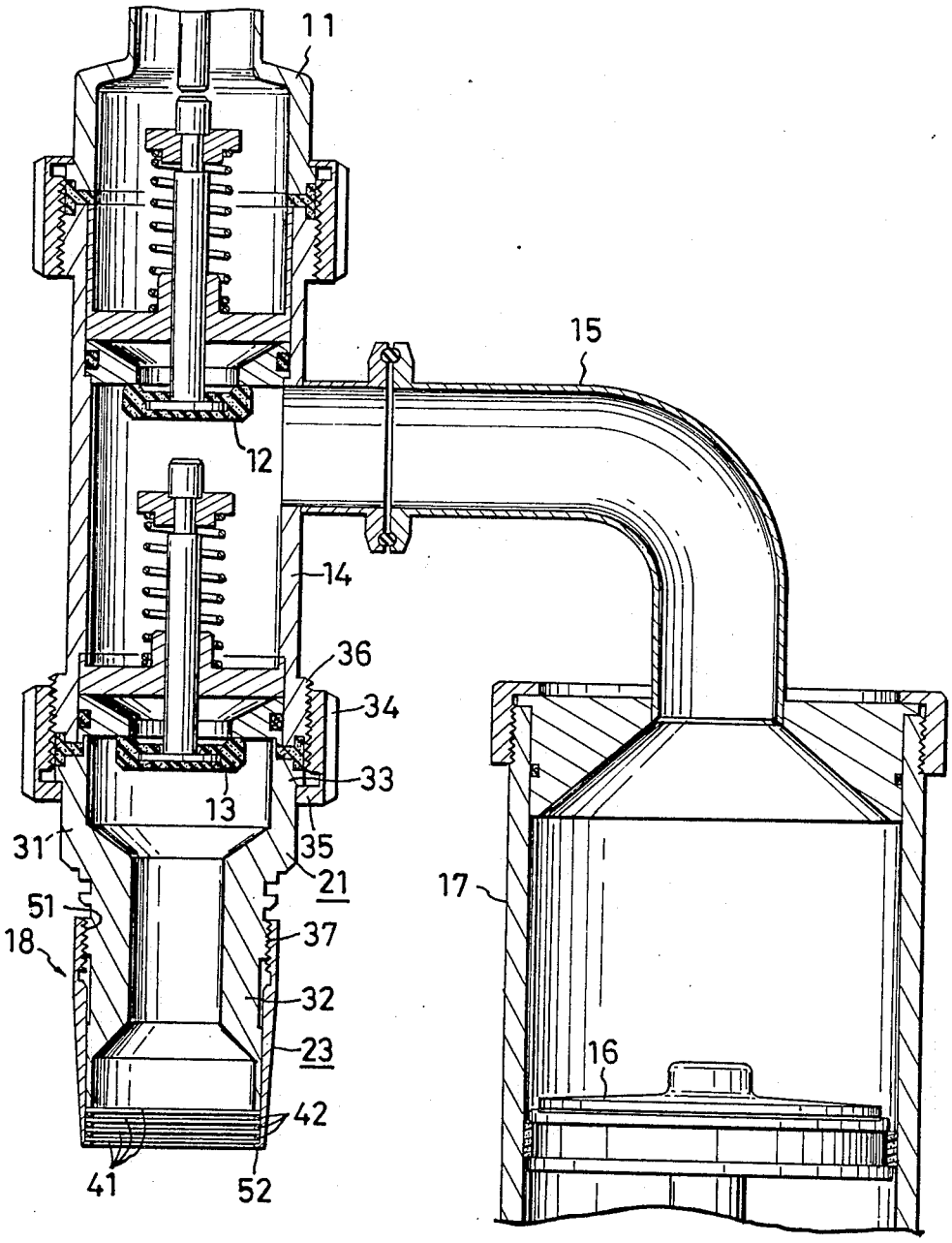
FIG. 1 is a view in vertical section.

FIG. 1 shows a liquid filling device which comprises a filling cylinder 14 connected by a pipe 11 a tank (not shown) containing the liquid to be filled and having upper and lower check valves 12, 13, a metering cylinder 17 connected by a pipe 15 to a lengthwise intermediate portion of the filling cylinder 14 and having a piston 16 therein, and a filling nozzle 18 connected to the lower end of the filling cylinder 14.

Of the components of the filling device, those other than the filling nozzle 18 are known and will not be described.

The filling nozzle 18 comprises a tubular nozzle body 21 having an open lower end, four perforated plates 41 arranged one above another at a spacing and covering the open lower end, and a tubular mount member 23 for removably attaching these perforated plates 41 to the lower end of the nozzle body 21.

The nozzle body 21 comprises an upper large-diameter portion 31 having substantially the same diameter as the filling cylinder 14 and a lower small-diameter portion 32. The large-diameter portion 31 has a flange 33 around its upper end. A flanged nut 34 is screwed on an externally threaded portion 36 of the filling cylinder 14, with a flange 35 of the nut 34 engaged with the flange 33 from below, whereby the nozzle body 21 is connected to the filling cylinder 14. The lower small-diameter portion 31 is externally threaded as at 37 at its lengthwise midportion.

An annular spacer 42 is interposed between the peripheral edges of each two adjacent perforated plates 41. The annular spacer 42 is for forming a clearance between adjacent perforated plates. The clearance which is determined by the thickness of the spacers effect the prevention of liquid from flowing down.

The mount member 23 has an inner surface generally fittable to the outer surface of the lower small-diameter portion 32 of the nozzle body 21 and has an internally threaded upper end 51 and a lower end formed with an inward flange 52. The four perforated plates 41 are placed on the flange 52 along with the spacers 42. As can be seen in FIG. 1 and with the above-described structural arrangement, the spacers 42 are detachable from the flange 52 of the mount member 23 so that the spacers 42 can be replaced depending on the type of liquid being prevented from flowing out. The internally threaded end 51 is screwed on the externally threaded part 37 of the lower small-diameter portion 32, and the assembly of the perforated plates 41 and the spacers 42 is clamped at its peripheral portion from above and below by the small-diameter portion 32 and the flange 52.

Figure 2:
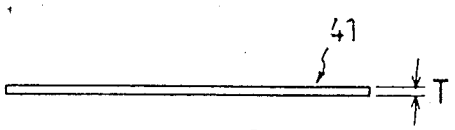
FIG. 2 is a side elevation of a perforated plate.
Figure 3:
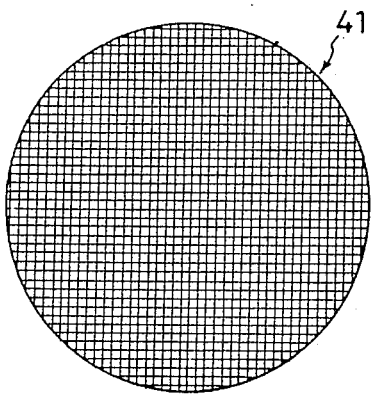
FIG. 3 is a plan view of the same.
Figure 4:
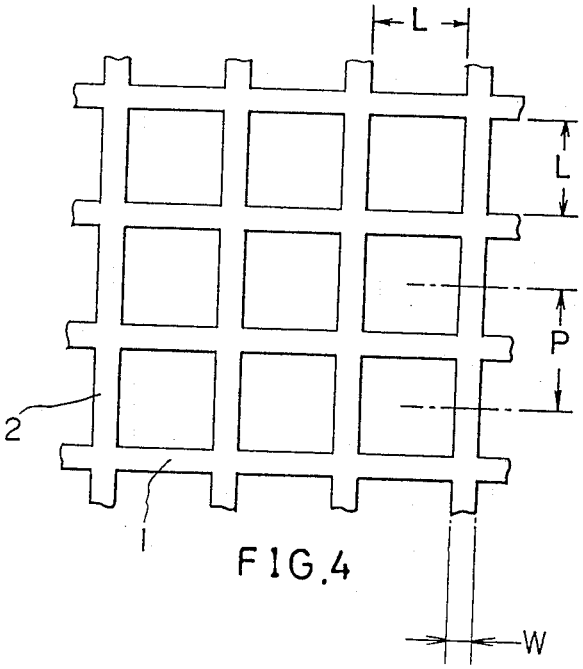
FIG. 4 is an enlarged fragmentary plan view of FIG. 3.

With reference to FIGS. 2 and 3, the perforated plate 41 has a circular contour conforming to the shape of the lower end opening of the nozzle body 21 and is made of stainless steel in order to further aid in the effective cleaning and sterilization thereof. The plate 41 has square openings formed by etching and accordingly appears like metal netting when seen from the front. The perforated plate 41 will be described with reference to specific numerical values. The plate is 0.5 to 1.0 mm in thickness T. The plate has insufficient strength if thinner and is difficult to etch if thicker. The size of the openings is limited by the etching process, so that the length L of one side of the opening is not smaller than the thickness T multiplied by 0.8. For example, when the thickness T is 0.5 mm, the minimum size of the opening is 0.4 mm$\times$0.4 mm. If the thickness T is 1.0 mm, the minimum size of the opening is 0.8 mm$\times$0.8 mm. The linear lattice-like straight portions defining the openings are not smaller than 0.1 mm in width W to assure proper etching. Accordingly, the opening pitch P is not smaller than the length L of one side of the opening added by 0.1 mm.

The opening ratio of the perforated plate will herein be defined as follows, and the opening ratio will be calculated specifically with reference to some examples of perforated plates. The opening ratio of this invention which is hereinafter described in more detail is consistent with the objectives of this invention for preventing the liquid from flowing out of the nozzle by the surface tension of the liquid against gravity and for allowing thereof to be effectively cleaned and sterilized.

$$\text{Opening ratio } (Q) = (\text{Total volume of openings only, of plate/Total volume of plate inclusive of openings}) \times 100\ (\%)$$
$$= [L^2 \cdot T/(L + W)^2 \cdot T] \times 100\ (\%)$$

Suppose the plate thickness T is 0.5 mm, the length L of one side of the opening is 0.4 mm, and the width W of the opening-defining straight portion is 0.1 mm, the ratio is given by:

$$\text{Opening ratio } (Q) = [0.4^2 \times 0.5/(0.4 + 0.1)^2 \times 0.5] \times 100$$
$$= 64\ (\%)$$

Further suppose the thickness T is 1.0 mm, the length L of one side of the opening is 0.8 mm, and the width W of the opening-defining straight portion is 0.1 mm. The opening ratio Q is given by:

$$\text{Opening ratio } (Q) = [0.8^2 \times 1.0/(0.8 + 0.1)^2 \times 1.0] \times 100$$
$$= 79\ (\%)$$

Figure 5A:
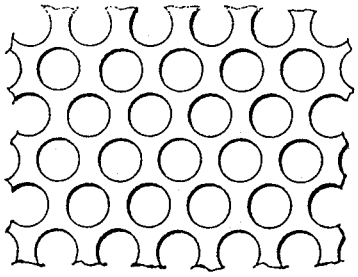
FIG. 5 includes fragmentary plan views showing modified perforated plates.
Figure 5B:
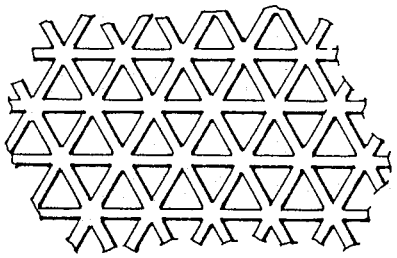
Figure 5C:
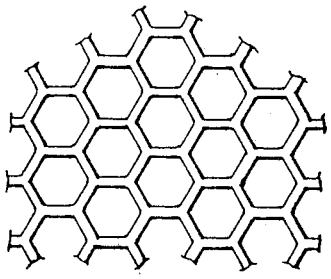

For reference, the opening ratio of wire nets conventionally used will be calculated. With a 20-mesh net which is 0.4 mm in wire diameter, the opening ratio is 47%. A 40-mesh net, 0.25 mm in wire diameter, has an opening ratio of 37%. The four perforated plates 41 used in the above embodiment are not limitative; one to about six perforated plates 41 are usable. The openings of the perforated plate 41, which are square in the embodiment, may alternatively be circular, triangular or hexagonal as shown in FIG. 5(*a*), FIG. 5(*b*) and FIG. 5(*c*), respectively.

Figure 6:
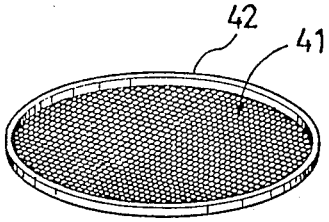
FIG. 6 is a perspective view showing another modified perforated plate.

Further as seen in FIG. 6, the perforated plate may be provided with a spacer 42 which is integral with its peripheral edge.

As a matter of convenience, portion 1 may be called weft and portion 2 may be called warp.

While the invention has been particularly shown and described in reference to preferred embodiments thereof, it will be understood by those skilled in the art that changes in form and details may be made therein without departing from the spirit and scope of the invention.

What is claimed is:

1. A plurality of perforated plates for use in a liquid filling device, said plurality of perforated plates arranged adjacent one another, each of said perforated plates, comprising a plurality of warp portions and weft portions so as to provide a plurality of fine perforations therebetween, said plurality of warp portions and weft portions being directly connected to each other at intersection points so as to prevent overlapping of said plurality of warp and weft portions to thereby allow effective cleaning and sterilizing of said plurality of perforated plates; and a spacer arranged within a spacing between adjacent perforated plates; wherein an opening ratio of each of said plurality of perforated plates is substantially 50 percent or more to thereby prevent liquid from flowing therethrough by gravity through surface tension of said liquid against said plurality of warp portions and weft portions, said opening ratio of each of said plurality of perforated plates being the ratio of the total volume of openings of said plate to the total volume, inclusive of said openings, of said plate.

2. The plurality of perforated plates of claim 1, wherein each of said plurality of perforated plates is stainless steel.

3. The plurality of perforated plates of claim 1, wherein said plurality of perforations are formed by etching.

4. The plurality of perforated plates of claim 1, wherein each of said plurality of perforations has a shape of a square.

5. The plurality of perforated plates of claim 4, wherein a side of said square has a length at least substantially equivalent to a thickness of said perforated plate multiplied by 0.8.

6. The plurality of perforated plates of claim 5, wherein the length of said side is substantially from 0.4 to 0.8 mm.

7. The plurality of perforated plates of claim 1, wherein each of said plurality of perforations has a shape of a circle.

8. The plurality of perforated plates of claim 1, wherein each of said plurality of perforations has a shape of a triangle.

9. The plurality of perforated plates of claim 1, wherein each of said plurality of perforations has a shape of a hexagon.

10. The plurality of perforated plates of claim 8, wherein each of said plurality of perforated plates has a thickness substantially from 0.5 to 1.0.

11. The plurality of perforated plates of claim 1, wherein the width of each warp portion or each weft portion is at least 0.1 mm.

12. A plurality of perforated plates for use in a liquid filling device, said plurality of perforated plates arranged adjacent one another, each of said plurality of perforated plates, comprising a plurality of warp portions and weft portions so as to provide a plurality of fine perforations therebetween to thereby prevent liquid from flowing therethrough by gravity through surface tension of said liquid against said plurality of warp portions and weft portions, said plurality of warp and weft portions being directly connected to each other at intersection points so as to prevent overlapping of said warp and weft portions to thereby allow effective cleaning and sterilizing of said plurality of perforated plates; and a spacer arranged within a spacing between adjacent perforated plates, wherein each of said plurality of perforated plates has a thickness substantially from 0.5 to 1.0 mm.

* * * * *